US007898559B2

(12) United States Patent
Kobayashi

(10) Patent No.: US 7,898,559 B2
(45) Date of Patent: Mar. 1, 2011

(54) IMAGE FORMING APPARATUS

(75) Inventor: Takahiko Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 885 days.

(21) Appl. No.: 11/654,617

(22) Filed: Jan. 18, 2007

(65) Prior Publication Data

US 2007/0182806 A1 Aug. 9, 2007

(30) Foreign Application Priority Data

Feb. 3, 2006 (JP) ..... 2006-027798

(51) Int. Cl.
*B41J 2/385* (2006.01)

(52) U.S. Cl. ..... 347/158

(58) Field of Classification Search ..... None
See application file for complete search history.

(56) References Cited

U.S. PATENT DOCUMENTS 6,585,349 B1 * 7/2003 Lou et al. ..... 347/33

FOREIGN PATENT DOCUMENTS

| | | |
|---|---|---|
| JP | 09-080875 | 3/1997 |
| JP | A-2001-343876 | 12/2001 |
| JP | A-2004-17607 | 1/2004 |

* cited by examiner

*Primary Examiner*—Stephen D Meier
*Assistant Examiner*—Alexander C Witkowski
(74) *Attorney, Agent, or Firm*—Morgan, Lewis & Bockius LLP

(57) ABSTRACT

An image forming apparatus includes an optical scanning unit having a light transmitting portion, the cleaning mechanism that includes a cleaning rod with a pad at a front end portion thereof to be capable of cleaning a surface of the light transmitting portion by sliding on the light transmitting portion, and a retaining mechanism that retains the cleaning rod slidably in a longitudinal direction of the light transmitting portion, and that retains the pad positioned above the optical scanning unit and spaced apart from the optical scanning unit in a state where the cleaning rod is at an insertion completed position.

7 Claims, 20 Drawing Sheets

IMAGE FORMING APPARATUS

BACKGROUND

1. Technical Field

This invention generally relates to image forming apparatuses such as digital copying machines with electrophotographic systems, laser printers, and the like.

2. Related Art

In image forming apparatuses that employ electrophotographic systems, in general, a light emitted from an optical scanning device composed of: a light source such as a semiconductor laser; and various optical parts is exposed to a photosensitive drum serving as an image holding body uniformly charged to form a latent image. Then, the latent image is developed with toner. Such developed toner image is transferred to a recording medium.

In the above-described image forming apparatus, when the toner or dusts are adhered to various optical parts included in the optical scanning device, high image quality cannot be maintained. For this reason, there is known a configuration in which the optical parts included in the optical scanning device are accommodated in a hermetically sealed chassis and the photosensitive drum is exposed to a light through a seal glass (light transmitting portion) arranged at the chassis. There is known another configuration in which the seal glass is provided at a chassis of an optical scanning unit is provided with a cleaning mechanism that removes the toner or ducts adhered to the surface of the seal glass. In the above-described cleaning mechanism, the surface of the seal glass is cleaned by sliding a pad provided at an end of a cleaning rod, when the cleaning rod is inserted or pulled out.

SUMMARY

According to an aspect of the present invention, an image forming apparatus comprises an optical scanning unit having a light transmitting portion, a cleaning mechanism including: a cleaning rod with a pad at an end portion thereof to be capable of cleaning a surface of the light transmitting portion by sliding on the light transmitting portion; and a retaining mechanism that retains the cleaning rod slidably in a longitudinal direction of the light transmitting portion, and that retains the pad positioned above the optical scanning unit and spaced apart from the optical scanning unit in a state where the cleaning rod is at an insertion completed position.

BRIEF DESCRIPTION OF THE DRAWINGS

Exemplary embodiments of the present invention will be described in detail based on the following figures, wherein.

DETAILED DESCRIPTION

A description will now be given, with reference to the accompanying drawings, of exemplary embodiments of the present invention.

Figure 1:
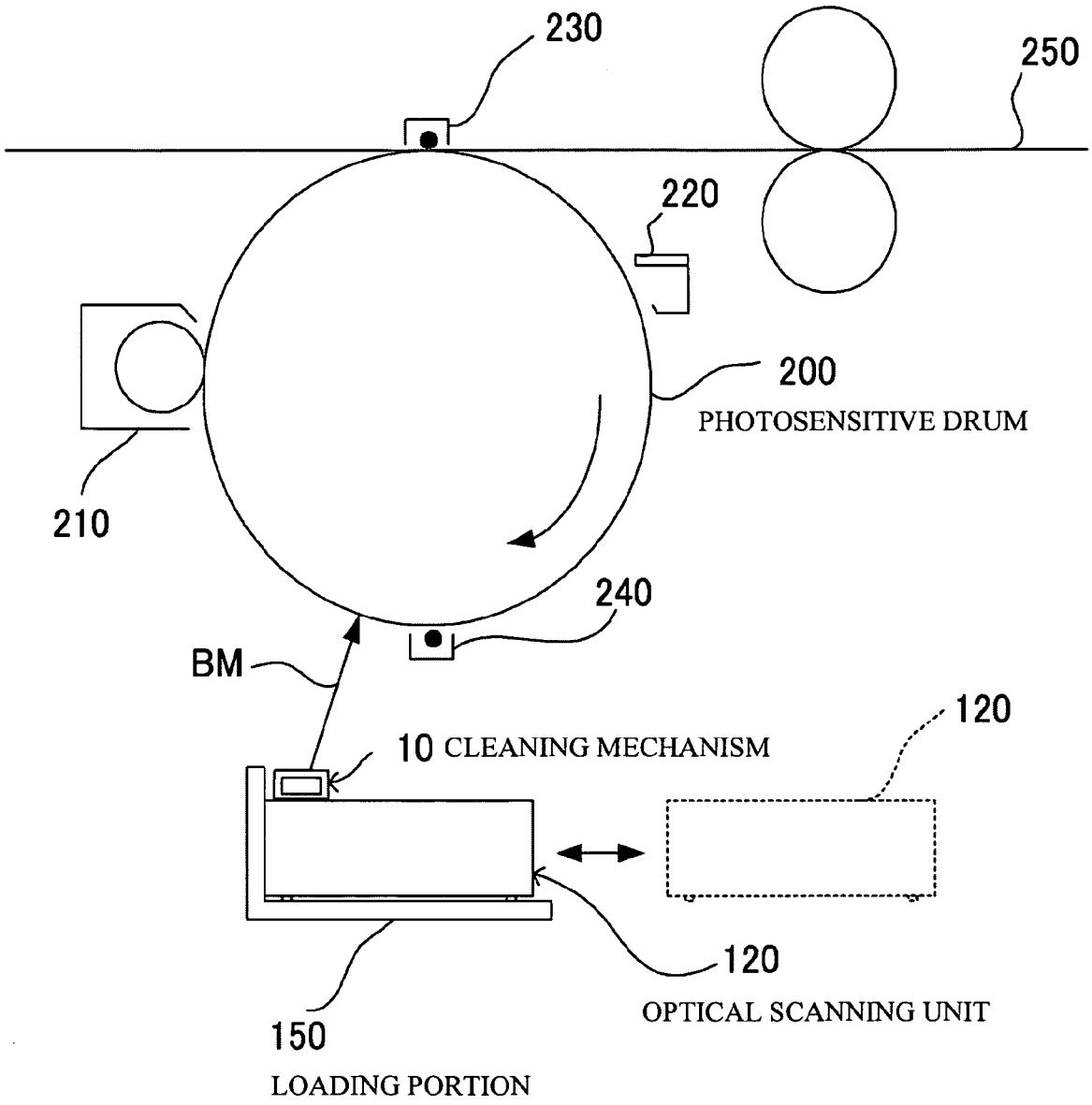
FIG. 1 shows an example of a schematic configuration of the image forming apparatus according to an aspect of the present invention.
Figure 2:
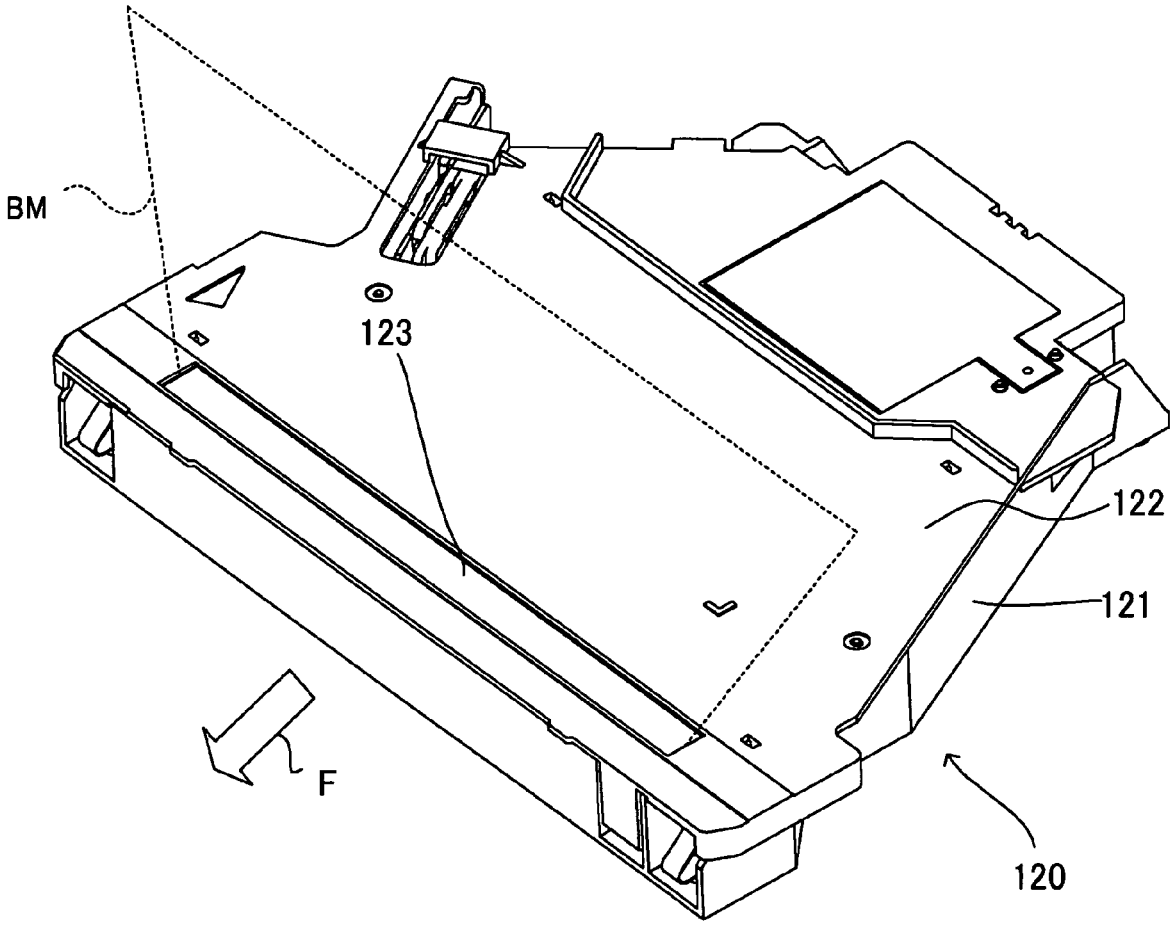
FIG. 2 is an external perspective view of an optical scanning unit according to an aspect of the present invention.
Figure 3:
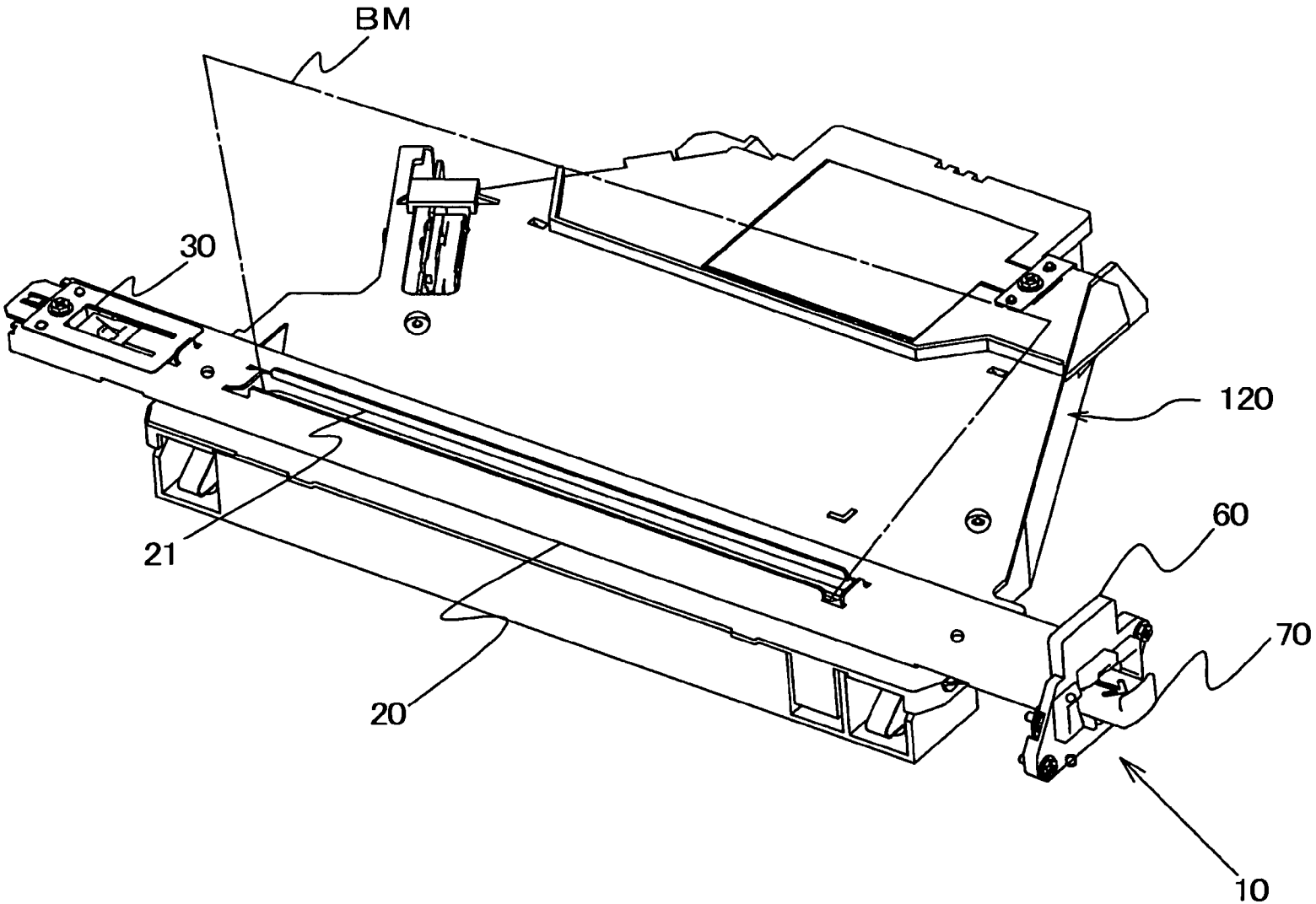
FIG. 3 is an external perspective view of a cleaning mechanism according to an aspect of the present invention.
Figure 4:
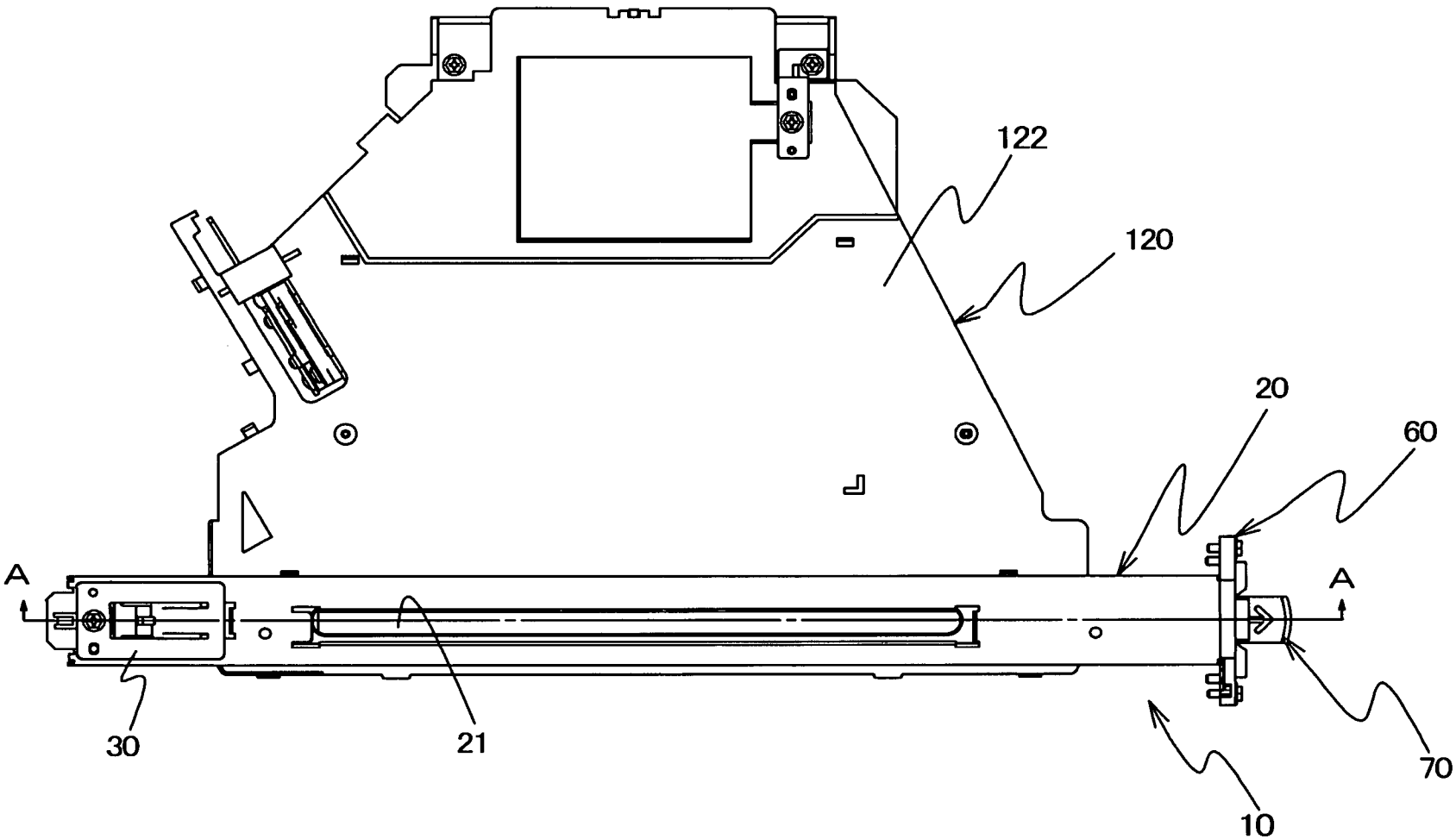
FIG. 4 is a plan view of the cleaning mechanism according to an aspect of the present invention.
Figure 5:
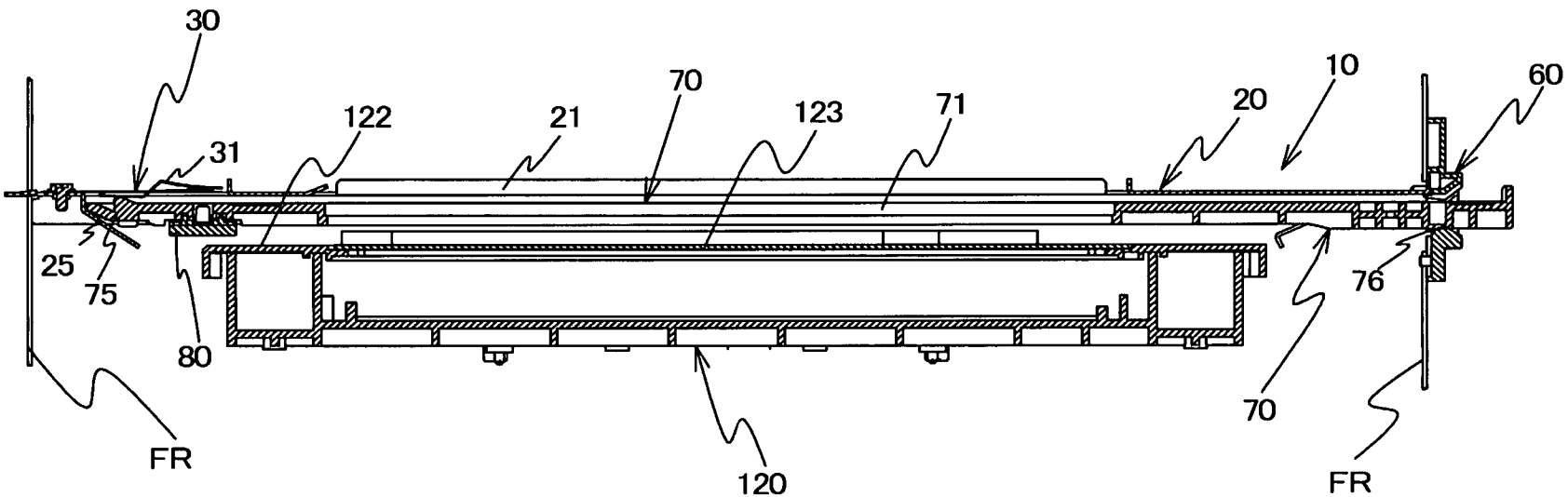
FIG. 5 is a cross-sectional view taken along the line A-A in FIG. 4.
Figure 6:
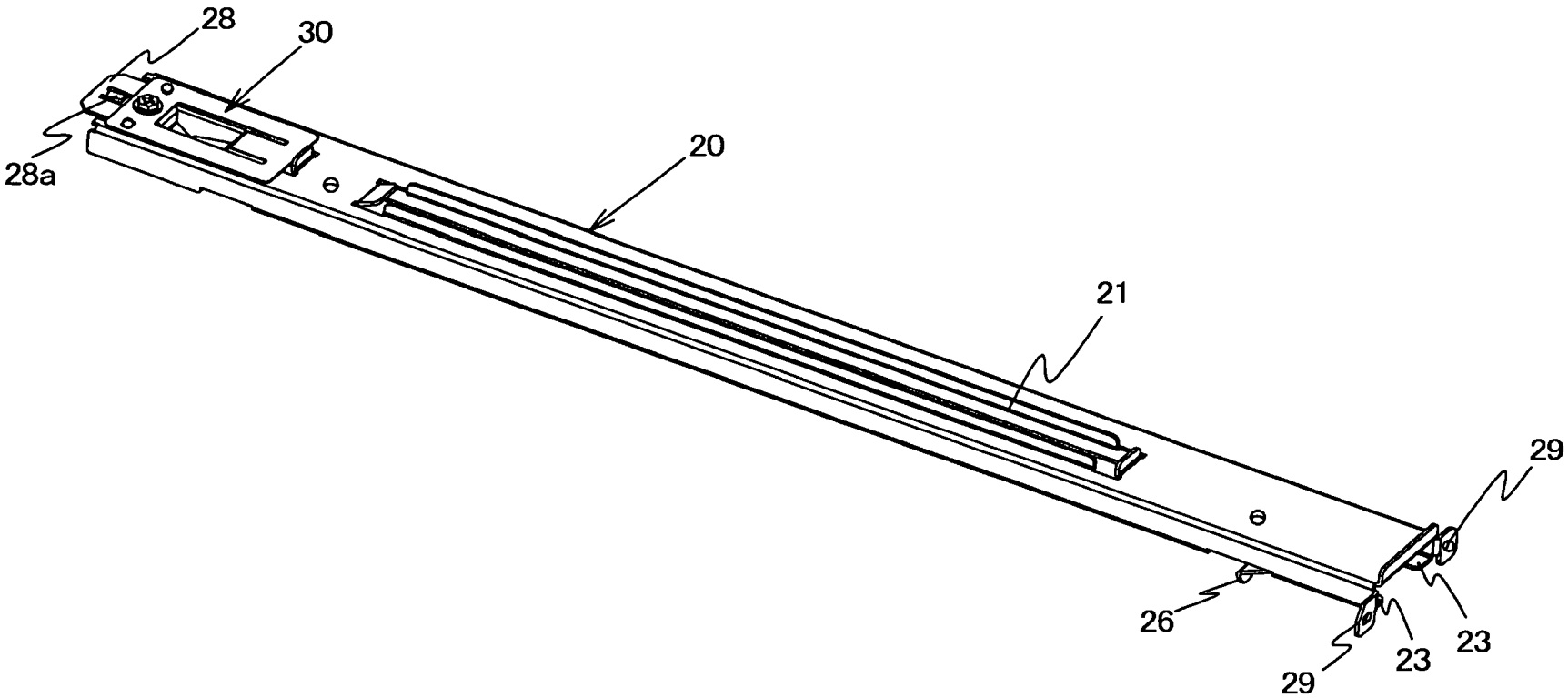
FIG. 6 is an external perspective view of guide rails according to an aspect of the present invention.
Figure 7:
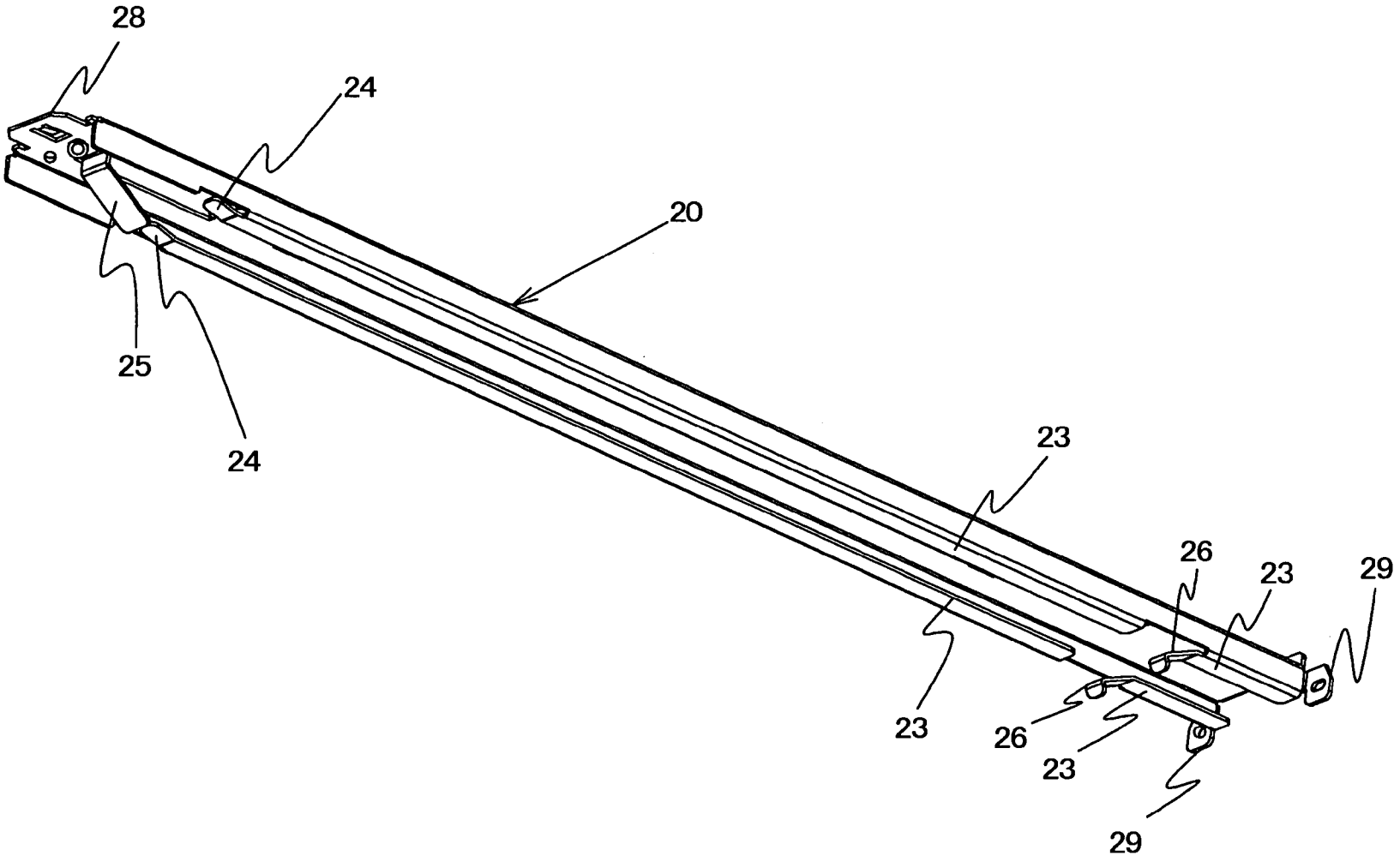
FIG. 7 is an external perspective view of the guide rails as viewed from the bottom surface thereof.
Figure 8:
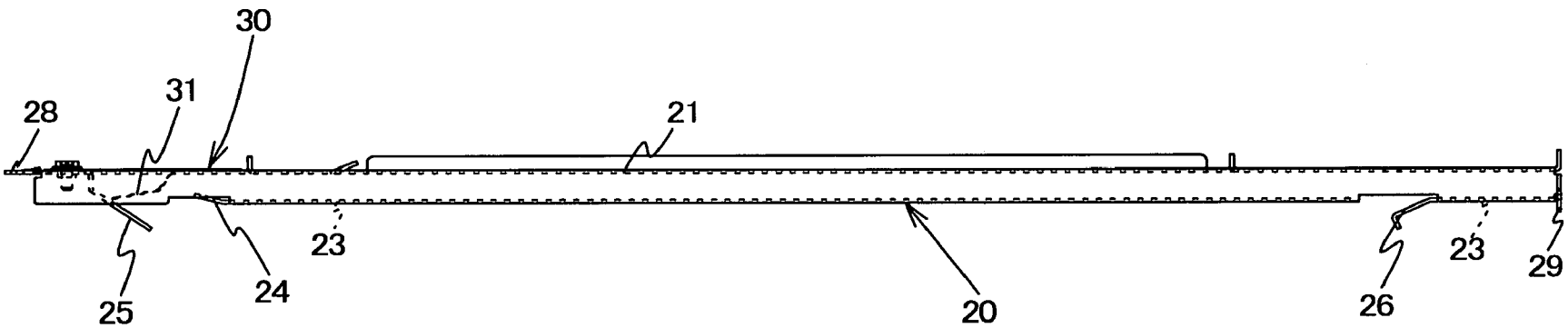
FIG. 8 is a side view of a guide rail.
Figure 9:
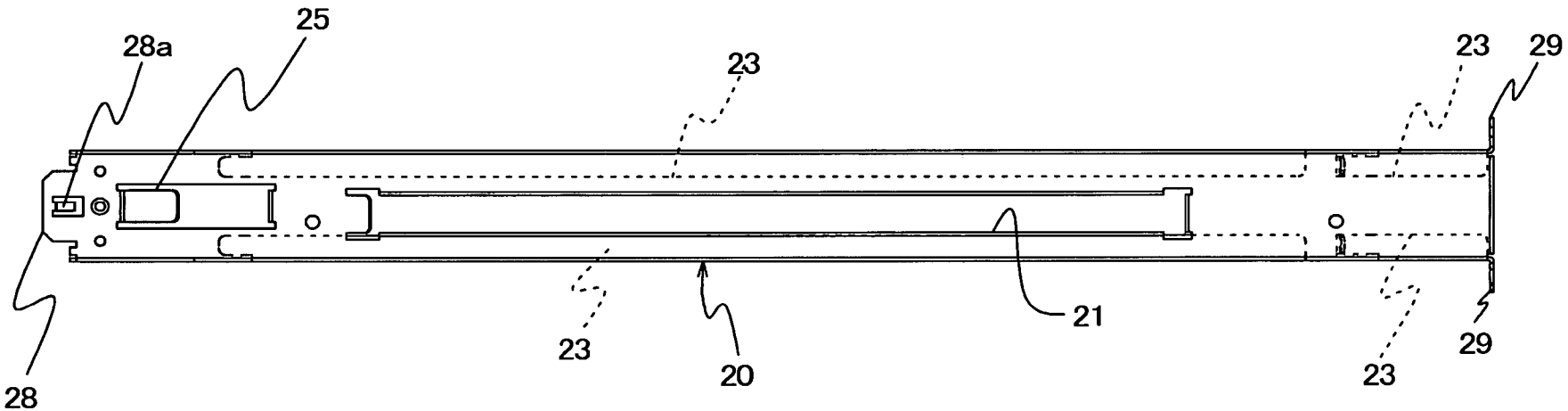
FIG. 9 is a plan view of the guide rails.
Figure 10A:
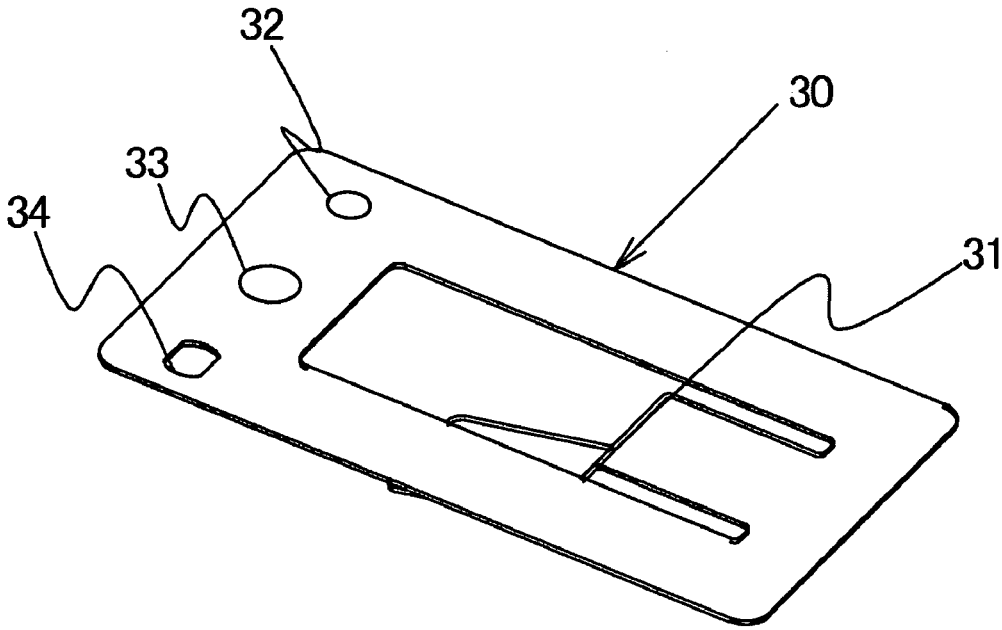
FIG. 10A is a perspective view of a spring member according to an aspect of the present invention.
Figure 10B:
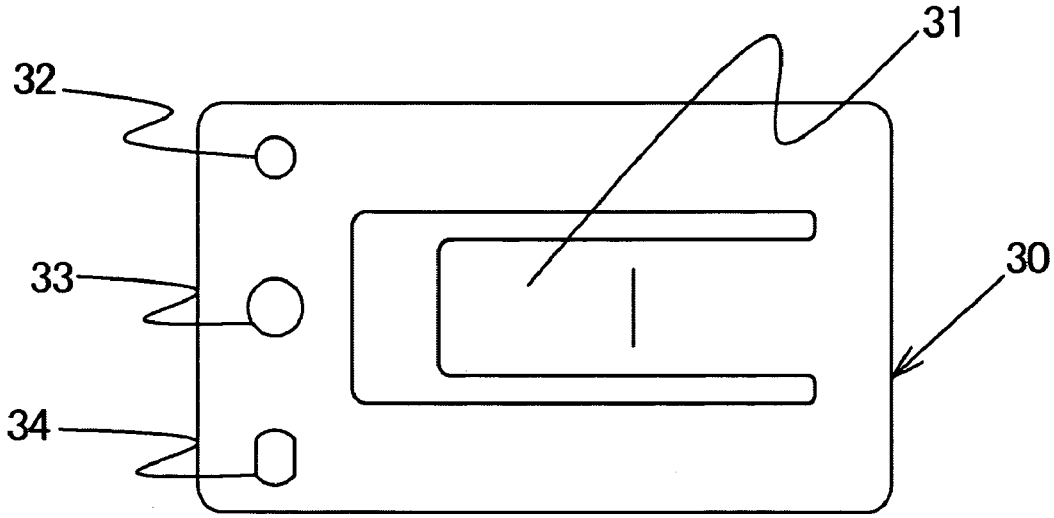
FIG. 10B is a plan view of the spring member according to an aspect of the present invention.
Figure 11A:
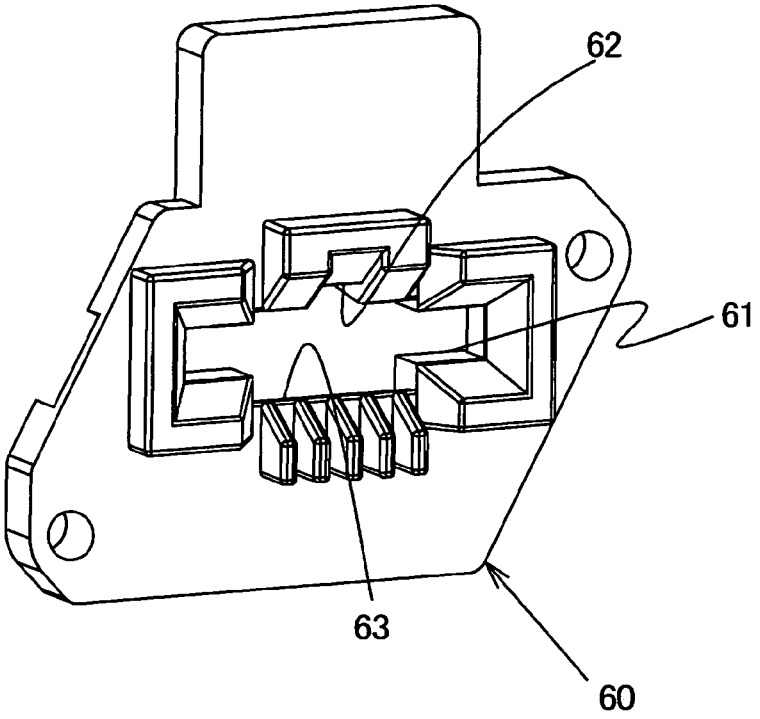
FIG. 11A is an external perspective view of a guiding member according to an aspect of the present invention.
Figure 11B:
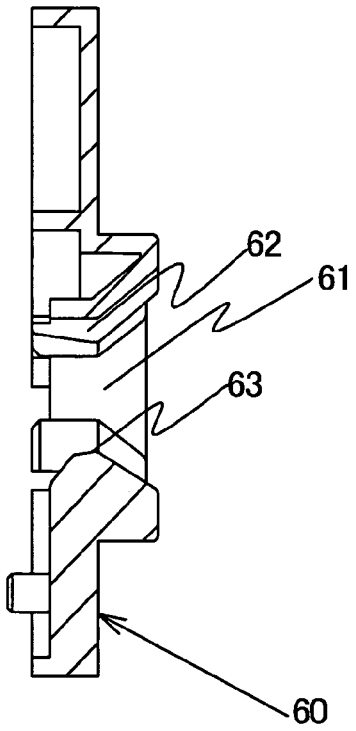
FIG. 11B is a cross-sectional view of the guiding member according to an aspect of the present invention.
Figure 12A:
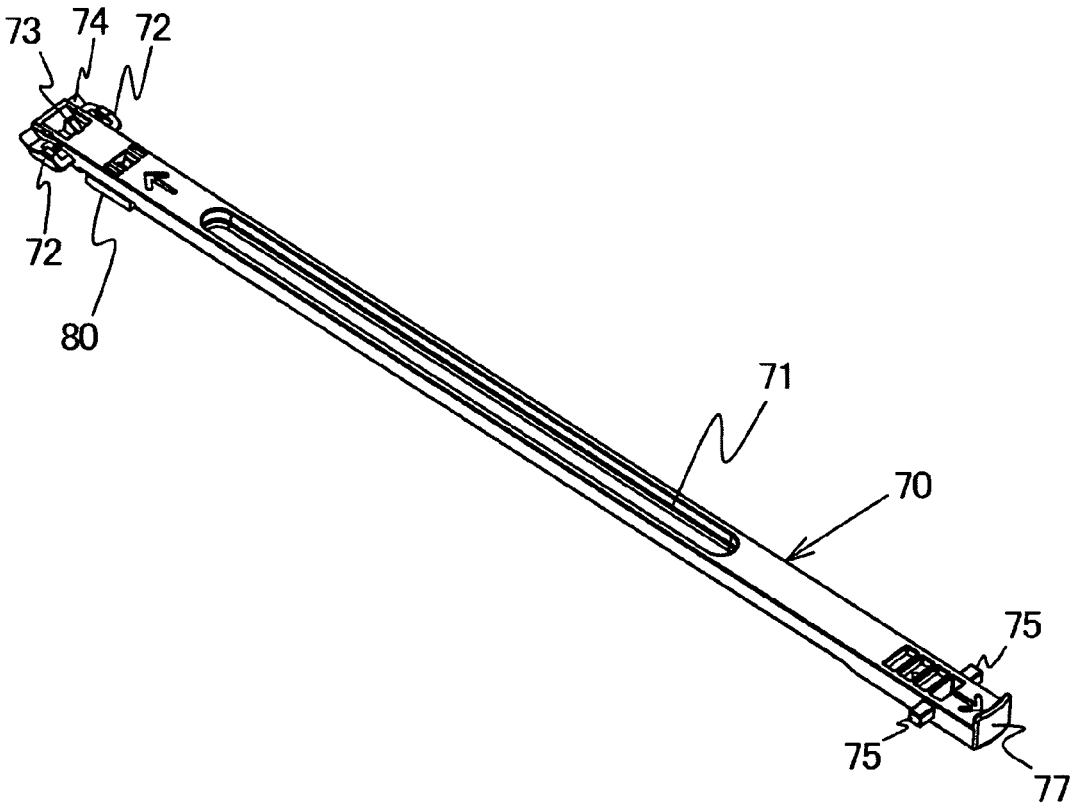
FIG. 12A and FIG. 12B are external perspective views as viewed from different directions according to an aspect of the present invention.
Figure 12B:
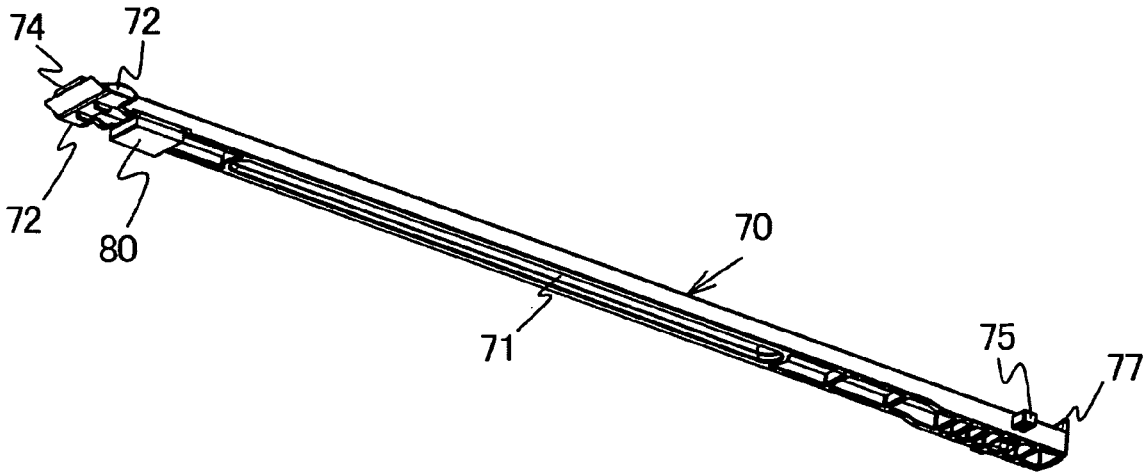
Figure 13A:
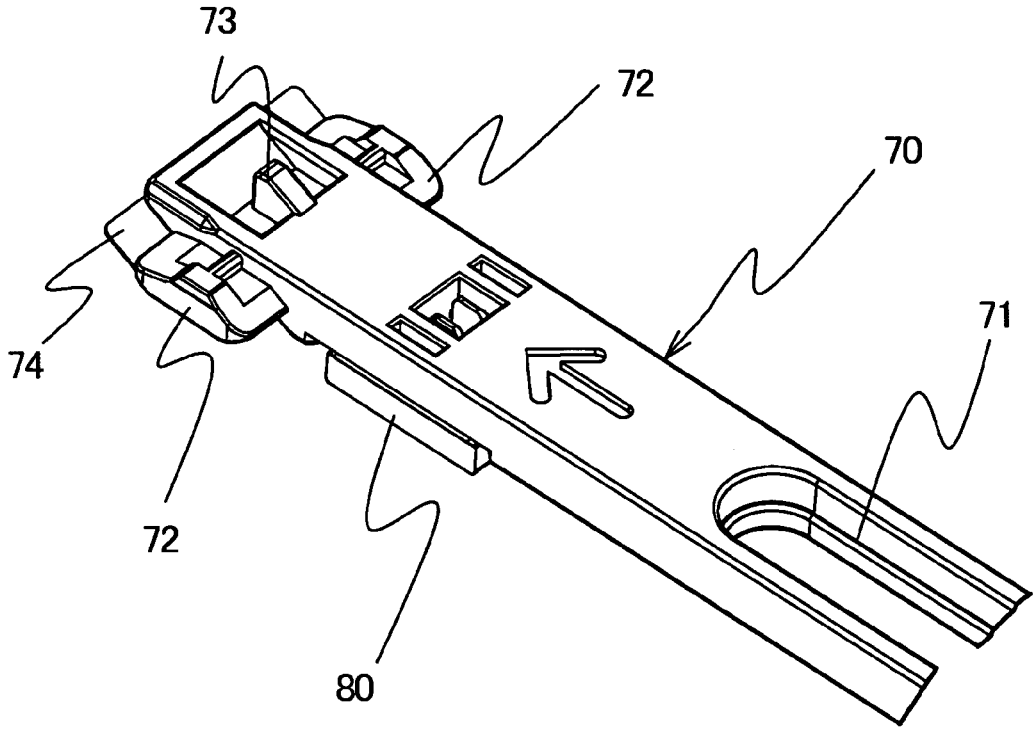
FIG. 13A and FIG. 13B are enlarged perspective views of a front end portion of the cleaning rod as viewed from different directions according to an aspect of the present invention.
Figure 13B:
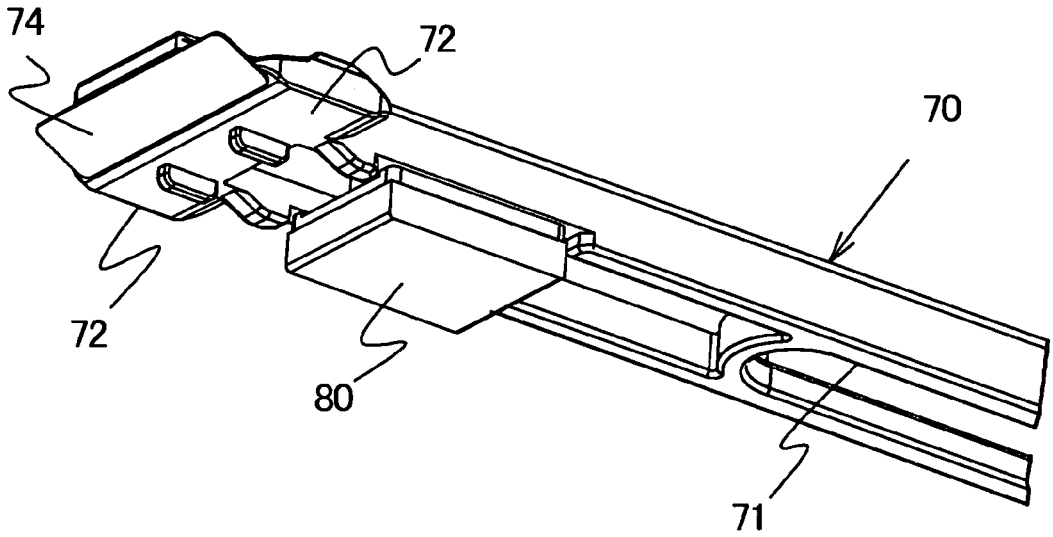
Figure 14A:
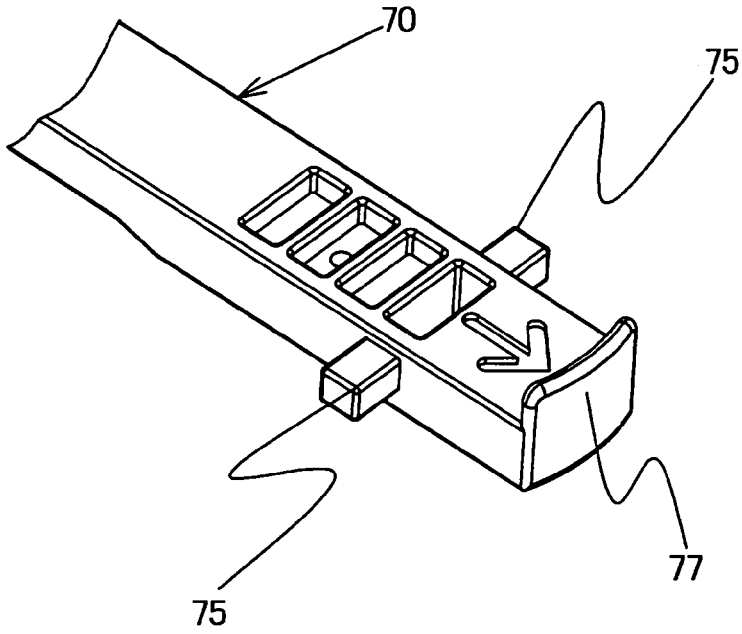
FIG. 14A and FIG. 14B are enlarged perspective views of the rear end portion of the cleaning rod as viewed from different directions according to an aspect of the present invention.
Figure 14B:
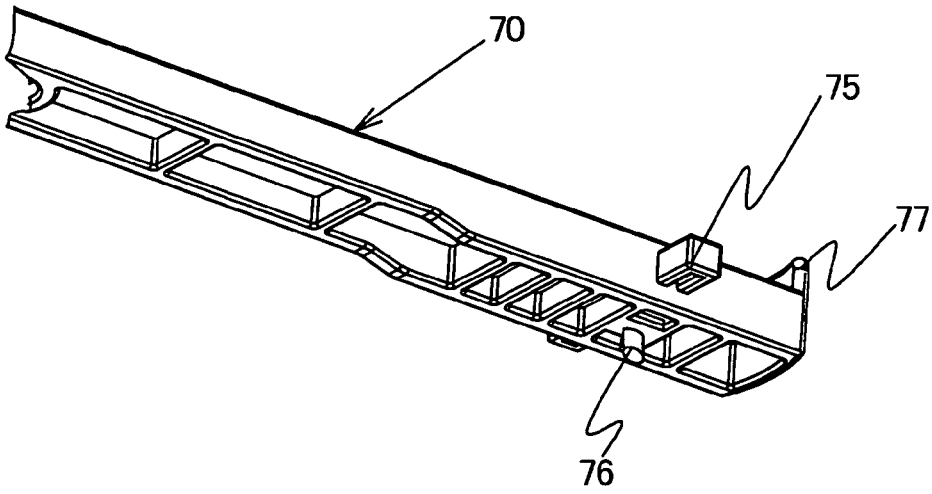
Figure 15:
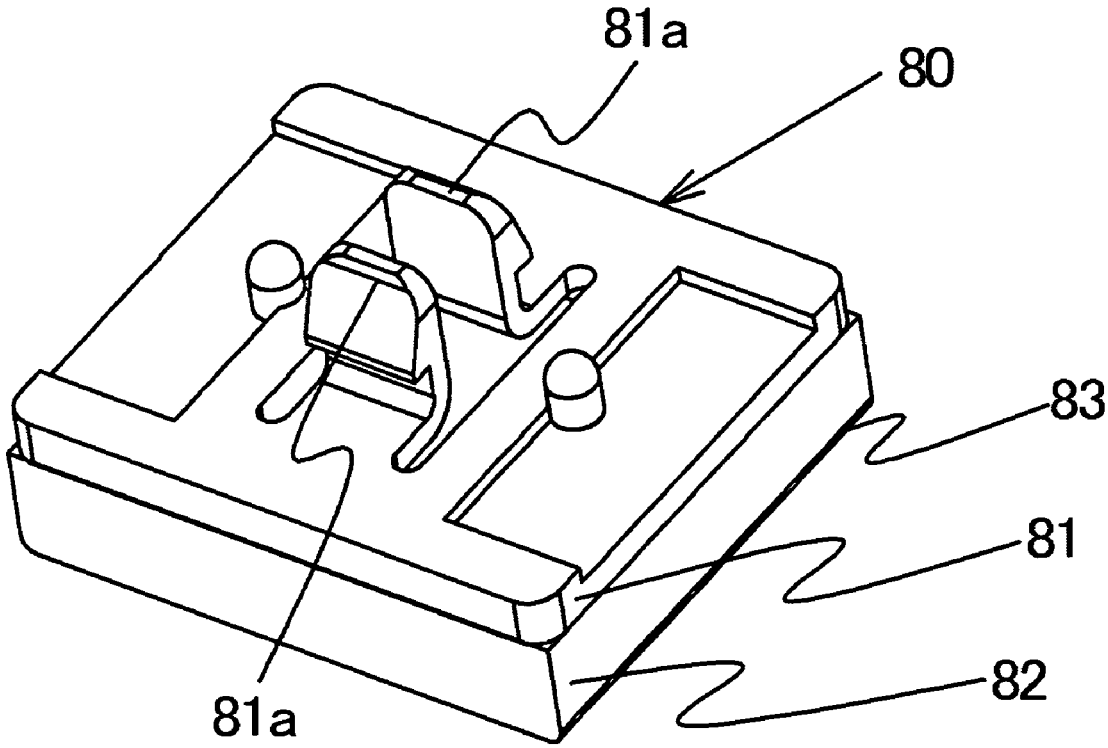
FIG. 15 is an external perspective view of a pad according to an aspect of the present invention.

FIG. 1 through FIG. 15 show an image forming apparatus according to aspects of the present invention. FIG. 1 shows an example of a schematic configuration of the image forming apparatus according to an aspect of the present invention. FIG. 2 is an external perspective view of an optical scanning unit according to an aspect of the present invention. FIG. 3 is an external perspective view of a cleaning mechanism according to an aspect of the present invention. FIG. 4 is a plan view of the cleaning mechanism according to an aspect of the present invention. FIG. 5 is a cross-sectional view taken along the line A-A in FIG. 4. FIG. 6 is an external perspective view of guide rails according to an aspect of the present invention. FIG. 7 is an external perspective view of the guide rails as viewed from the bottom surface thereof. FIG. 8 is a side view of a guide rail. FIG. 9 is a plan view of the guide rails. FIG. 10A is a perspective view of a spring member according to an aspect of the present invention. FIG. 10B is a plan view of the spring member according to an aspect of the present invention. FIG. 11A is an external perspective view of a guiding member according to an aspect of the present invention. FIG. 11B is a cross-sectional view of the guiding member according to an aspect of the present invention. FIG. 12A and FIG. 12B are external perspective views as viewed from different directions according to an aspect of the present invention. FIG. 13A and FIG. 13B are enlarged perspective views of a front end portion of the cleaning rod as viewed from different directions according to an aspect of the present invention. FIG. 14A and FIG. 14B are enlarged perspective views of the rear end portion of the cleaning rod as viewed from different directions according to an aspect of the present invention. FIG. 15 is an external perspective view of a pad according to an aspect of the present invention.

Referring to FIG. 1, the image forming apparatus employed in the present invention includes: a cleaning mechanism 10; an optical scanning unit 120; a loading portion 150 onto which the optical scanning unit 120 detachably loaded; a photosensitive drum 200 serving as an image holding body; a development unit 210; a cleaner unit 220; a transferring unit 230; a charging unit 240; intermediate transferring belt 250; and the like. The optical scanning unit 120 scans and exposes a beam BM between the charging unit 240 and the development unit 210 on the photosensitive drum 200. The above-described components are installed in a frame, not shown, which defines an external outline of the image forming apparatus.

A description will now be given of a fundamental movement of the image forming apparatus. The photosensitive drum 200 is uniformly charged by the charging unit 240. The charged surface of the photosensitive drum 200 is scanned by the beam BM from the optical scanning unit 120, and a latent image is formed. Next, the latent image formed on the photosensitive drum 200 is developed with toner by the development unit 210, and the toner image developed on the photosensitive drum 200 is transferred to the intermediate transferring belt 250 by the transferring unit 230. Then, the untransferred remaining toner, which is not transferred to the intermediate transferring belt 250 and remains on the photosensitive drum 200, is removed from the photosensitive drum 200 by the cleaner unit 220. The toner image transferred to the intermediate transferring belt 250 is transferred to a recording medium such as a paper by a mechanism, not shown.

Referring now to FIG. 2, the chassis of the optical scanning unit 120 is composed of: a housing member 121 that includes various parts therein; and a cover 122 that covers an upper portion of the housing member 121. The chassis of the optical scanning unit 120 defines an external outline. The cover 122 is provided with a seal glass 123 serving as a light transmitting portion that transmits a light. The seal glass 123 has the surface formed substantially identical to the surface of the cover 122. The housing member 121 and the cover 122 may be formed by use of a material such as resin, metal, or the like.

The optical scanning unit 120 is loaded onto the loading portion 150 in a loading direction F shown in FIG. 2, and is fixed at a base surface, not shown, of the loading portion 150.

The optical scanning unit 120 includes various optical parts, not shown, such as a semiconductor laser, scanning motor, polygon mirror, scanning lens, turn-back mirror, and the like. The beam emitted from the semiconductor laser is reflected by the polygon mirror rotated by the scanning motor, transmits through the scanning lens, is reflected by the turn-back mirror, transmits through the seal glass 123 serving as a light transmitting portion provided at the cover 122, and is emitted toward the photosensitive drum 200.

Referring now to FIG. 3 through FIG. 5, the cleaning mechanism 10 is opposed to the seal glass 123 (cover 122) of the optical scanning unit 120 and arranged along the longitudinal direction of the seal glass 123 so as to be fixed at a frame FR of the image forming apparatus. Normally, the surface of the seal glass 123 of the optical scanning unit 120 is cleaned according to a user's cleaning operation, described later, while securing the transmission of the beam BM output toward the photosensitive drum 200 from the optical scanning unit 120, as shown in FIG. 3.

The cleaning mechanism 10 is composed of: a guide rail member 20; a spring member 30; a retaining mechanism composed of a guiding member 60 and the like; and a cleaning rod 70 retained by the retaining mechanism.

Referring now to FIG. 6 through FIG. 10, for example, the guide rail member 20 is formed by pressing a sheet of metal, and includes: an opening portion 21 formed in the longitudinal direction of the upper surface thereof to transmit the beam BM; guide rails 23 formed in parallel with the longitudinal direction at the bottom surface side thereof, which is a side opposed to the optical scanning unit 120; a receiving portion 25 formed to be projected at an end portion thereof to receive the front end portion of the cleaning rod 70; an attaching portion 28 formed at an end side of the guide rail member 20; and a flange portion 29 formed at the rear end side thereof. FIG. 6 shows a state in which a plate spring member 30 is fixed at the end portion of the guide rail member 20.

The attaching portion 28 is provided with an elastically deformable engaging projection 28*a* projecting upward, so that the engaging projection 28*a* is attached to the frame FR by inserting the engaging projection 28*a* into an inserting opening, not shown, formed in the frame FR shown in FIG. 5 to be engaged therewith. The flange portion 29 is fastened and secured to the frame FR by a bolt, not shown.

The guide rails 23 are spaced apart from each other and located in parallel with each other, and are provided with end portions 24 tilted and formed upward at ends portions thereof; and guide portions 26 tilted and formed downward at a partway thereof. Since the guide portions 26 are formed at the partway of the guide rails 23, the guide rails 23 are cut away in the partway. A slide portion 72 of the cleaning rod 70, described later, is inserted from such cut portion, and is guided by the guide portion 26 onto the guide rails 23.

The receiving portion 25 is tilted toward the lower portion of the guide rail member 20, and receives the front end portion of the cleaning rod 70, described later.

Referring to FIG. 10A and FIG. 10B, the spring member 30 is composed of: a plate spring portion 31 formed in a cantilever shape; positioning openings 32 and 34 to be positioned at the top surface of the guide rail member 20; a through-hole 33 into which a bolt for fastening is inserted; and the like. The plate spring portion 31 of the spring member 30 protrudes from the upper side to the lower side of the guide rail member 20, as shown in FIG. 8, and elastically deforms in engagement with the front end portion of the cleaning rod 70, described later.

Referring to FIG. 11A and FIG. 11B, the guiding member 60 is formed of, for example, a material such as resin or the like so as to guide the cleaning rod 70, when the cleaning rod 70 is inserted into or pulled out of the cleaning mechanism 10. The guiding member 60 is fastened and secured at the frame FR by a bolt or the like, not shown.

The guiding member 60 is provided with an inserting opening 61 of a substantially rectangular shape so that the cleaning rod 70 can be inserted thereinto. The inserting opening 61 is provided with: a fitting groove 62 into which a reverse insertion preventing projection 73 of the cleaning rod 70, described later, can be fitted; and an escaping portion 63 through which a pad 80, described later, can be passed. The cleaning rod 70 cannot be inserted into the inserting opening 61, unless the cleaning rod 70 is inserted in a direction where the reverse insertion preventing projection 73, described later, is fitted into the fitting groove 62.

Referring to FIG. 12A through FIG. 14B, the cleaning rod 70 may be formed of, for example, a material such as resin or the like, and is composed of: an opening portion 71 formed in a longitudinal direction thereof so as to transmit the beam BM; the slide portion 72 projected at both sides of the end portion thereof; the reverse insertion preventing projection 73 projected from the upper surface of the end portion thereof; a contact portion 74 that can be engaged with the receiving portion 25 of the guide rail member 20 formed in a plate shape at the front end portion thereof; an engaging projection 75 that projects at both sides of the rear end portion thereof; an engaging projection 76 that projects from the lower surface of the rear end portion thereof; a holding portion 77 formed at the rear end thereof; and the pad 80 secured at the lower surface of the front end portion thereof; and the like.

The slide portion 72 can be engaged with the guide rails 23 of the guide rail member 20, respectively. When the cleaning rod 70 is inserted into the cleaning mechanism 10, the engaging projection 75 is fitted into the inserting opening 61 of the guiding member 60 to prevent air or dusts outside of the image forming apparatus from entering.

When the cleaning rod 70 is inserted to reach the insertion completed position of the cleaning mechanism 10, the engaging projection 76 is engaged with the guiding member 60 to prevent the cleaning rod 70 from being pulled out of the inserting opening 61.

The holding portion 77 projects from the rear end portion to be capable of holding the cleaning rod 70, when a user inserts or pulls the cleaning rod 70 into or out of the cleaning mechanism 10.

The contact portion 74 is formed in a plate shape and is also tilted in alignment with the inclination of the receiving portion 25 of the guide rail member 20. This makes it possible to move the cleaning rod 70 smoothly and thereby stabilizing the position thereof, when the contact portion 74 slides in contact with the receiving portion 25.

Referring now to FIG. 15, the pad 80 is composed of: a base 81 made of resin and secured at the lower surface of the front end portion of the cleaning rod 70; an elastic member 82 made of urethane sponge or the like secured at the base 81; a cleaning member 83 made of nonwoven fabric or the like secured at a surface of the elastic member 82 to clean the surface of the seal glass 123 of the optical scanning unit 120; and the like.

The pad 80 is exchangeably attached by snap fitting an engaging projection 81*a* formed at the base 81 onto the front end portion of the cleaning rod 70.

Next, referring to FIG. 16A through FIG. 18B, a description will be given of an operation example of the cleaning mechanism 10 when the cleaning rod 70 is inserted.

Figure 16A:
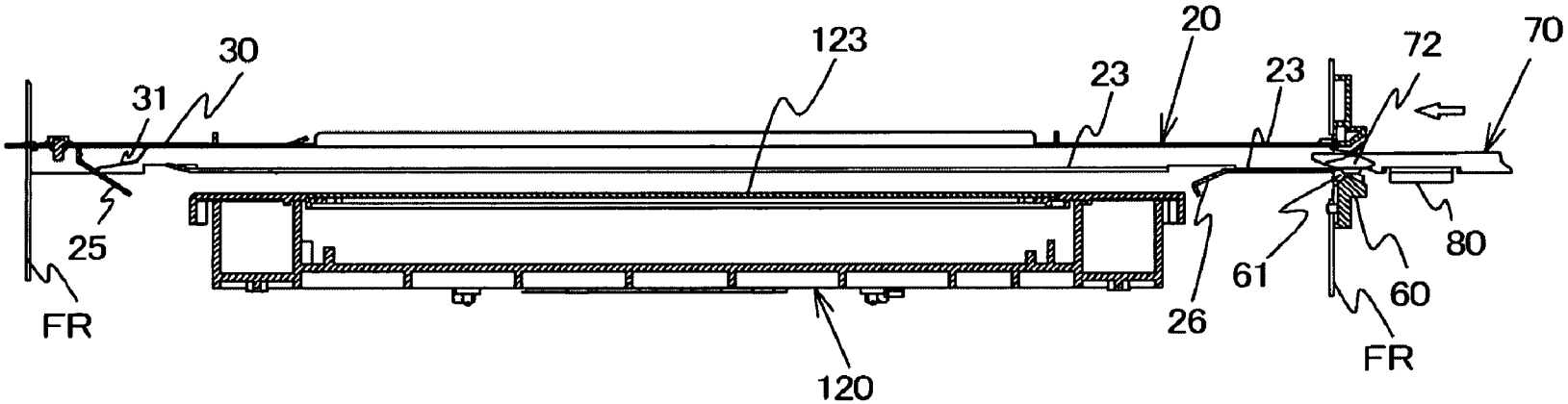
FIG. 16A and FIG. 16B are cross-sectional views showing an operation of the cleaning mechanism at the time of inserting the cleaning rod.

Firstly, when the cleaning rod 70 is inserted into the inserting opening 61 of the guiding member 60 from the state where the cleaning rod 70 is outside of the cleaning mechanism 10. As shown in FIG. 16A, the slide portion 72 of the cleaning rod 70 moves on the guide rails 23.

Figure 16B:
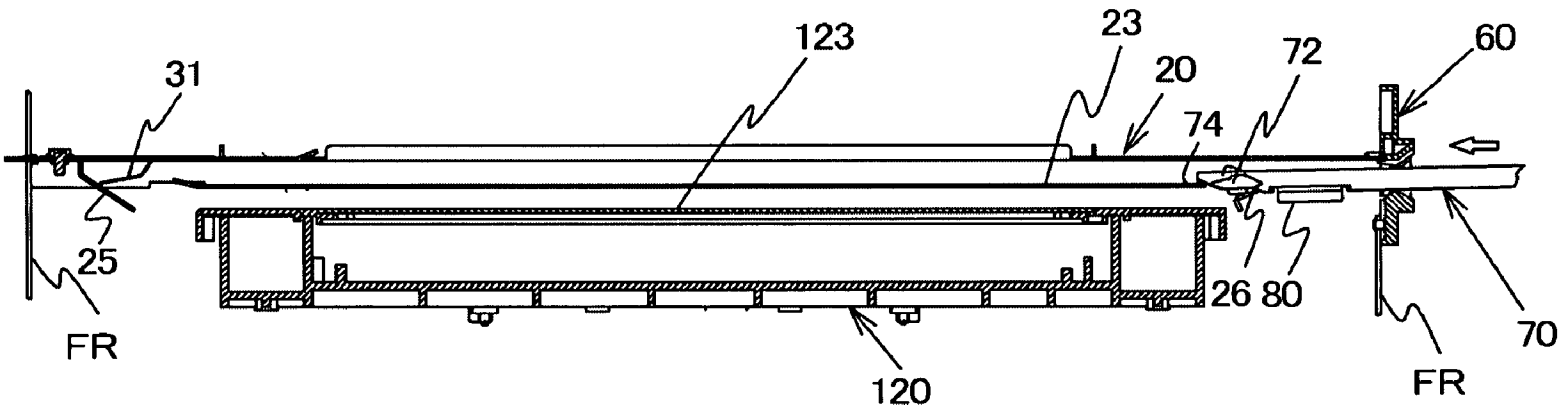

As the cleaning rod 70 is further inserted and the front end thereof reaches a portion where there is no guide rail 23 provided in the proximity of the guide portion 26, as shown in FIG. 16B, the contact portion 74 arranged at an end of the cleaning rod 70 moves onto the guide rails 23 again provided at the front side of the portion where there is no guide rail 23 provided, before the slide portion 72 drops into the portion where there is no guide rail 23 provided. This will not cause the slide portion 72 to be dropped into a discontinuous portion formed by the guide portion 26.

Figure 17A:
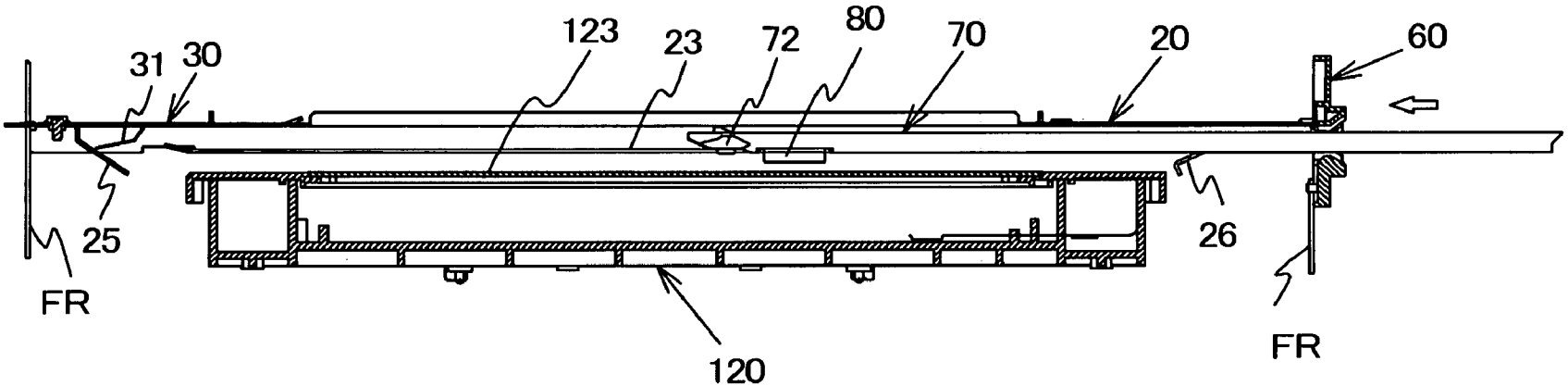
FIG. 17A and FIG. 17B are cross-sectional views showing the operation of the cleaning mechanism subsequent to FIG. 16B.

As the cleaning rod 70 is further inserted, the slide portion 72 moves sliding on the guide rails 23, as shown in FIG. 17A. At this time, the pad 80 moves at a given height spaced apart from the surface of the seal glass 123 between the guide rails 23 opposing each other.

Figure 17B:
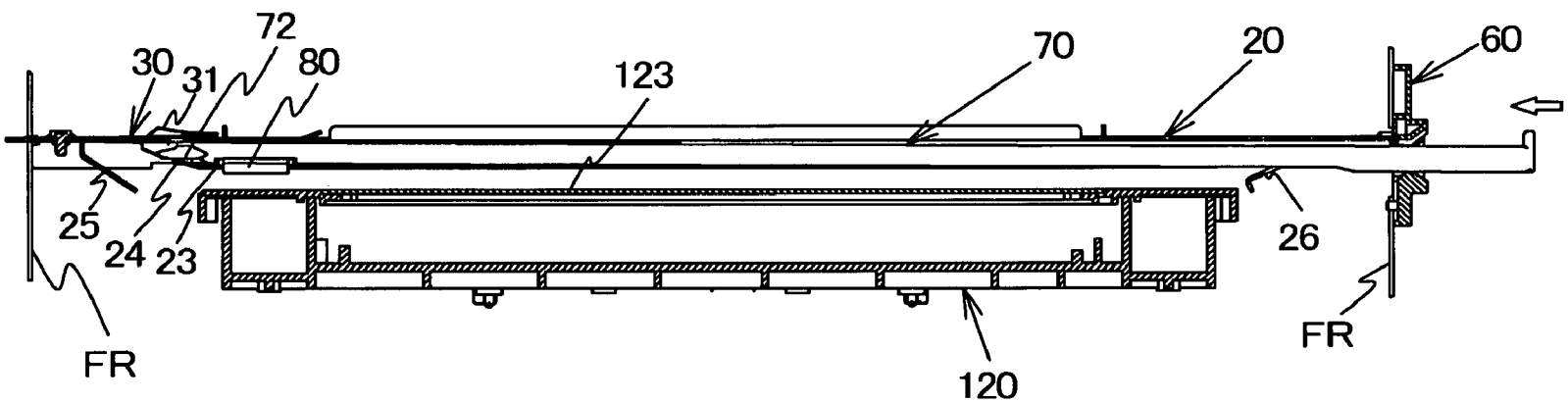

Then, as shown in FIG. 17B, when the slide portion 72 of the cleaning rod 70 moves onto the end portions 24 of the guide rails 23, the front end portion of the cleaning rod 70 moves upward and comes into contact with the plate spring portion 31, since the end portions 24 are tilted upward. Then, the plate spring portion 31 is elastically deformed. In this manner, a biasing force of the plate spring portion 31 is exerted downward at the front end portion of the cleaning rod 70.

Figure 18A:
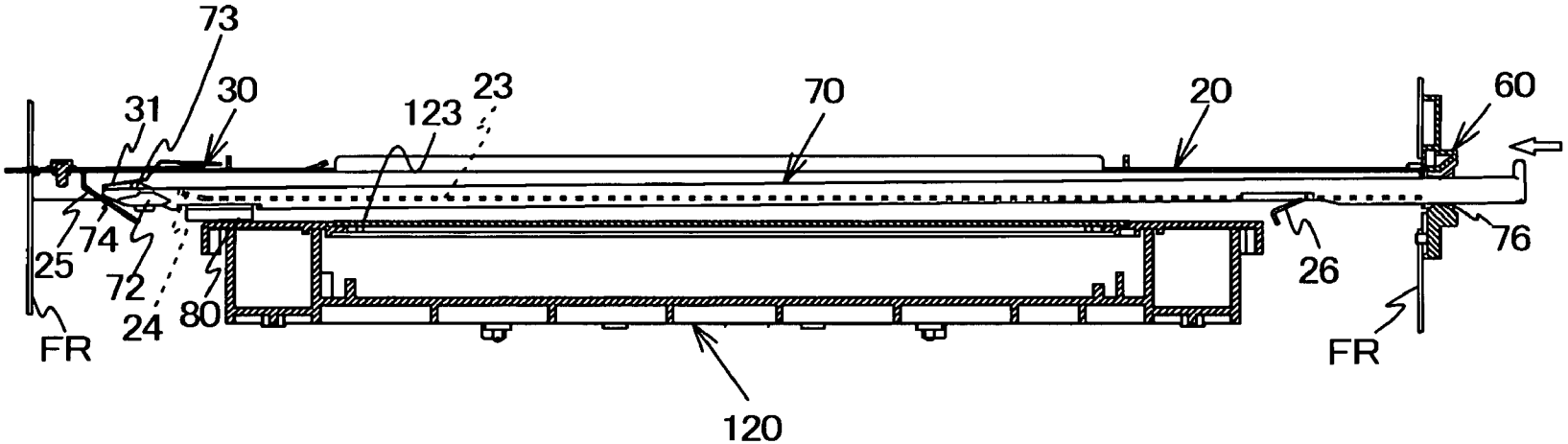
FIG. 18A and FIG. 18B are cross-sectional views showing the operation of the cleaning mechanism subsequent to FIG. 17B.

As the cleaning rod 70 is further inserted, the slide portion 72 of the cleaning rod 70 moves away from the end portions 24 of the guide rails 23, as shown in FIG. 18A. However, the receiving portion 25 of the guide rail member 20 receives the contact portion 74 of the cleaning rod 70.

Figure 18B:
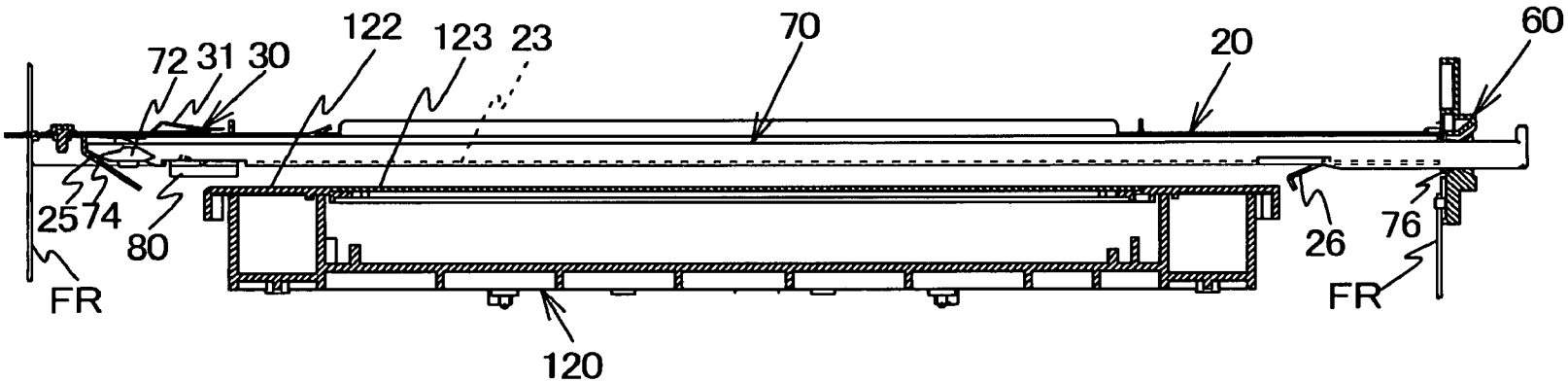

As the cleaning rod 70 is further inserted, the contact portion 74 moves upward on the receiving portion 25 that is tilted, as shown in FIG. 18B. Then, the front end portion of the cleaning rod 70 moves upward in a direction apart from the optical scanning unit 120, and in the end the movement thereof is regulated by the receiving portion 25. In this state, the engaging projection 76 formed at the back end portion of the cleaning rod 70 is engaged with a portion of the guiding member 60. This position is referred to as insertion completed position of the cleaning rod 70.

The front end portion of the cleaning rod 70, including the pad 80, is located above the cover 122 of the optical scanning unit 120, and is held by the receiving portion 25 with certainty in the state shown in FIG. 18B. This makes it possible to prevent the cleaning rod 70 and the optical scanning unit 120 from interfering with each other at the time of exchanging the optical scanning unit 120 at the loading portion 150.

Next, referring to FIG. 19A through FIG. 20B, a description will be given of an operation example of the cleaning mechanism 10 when the cleaning rod 70 is pulled (for cleaning).

Figure 19A:
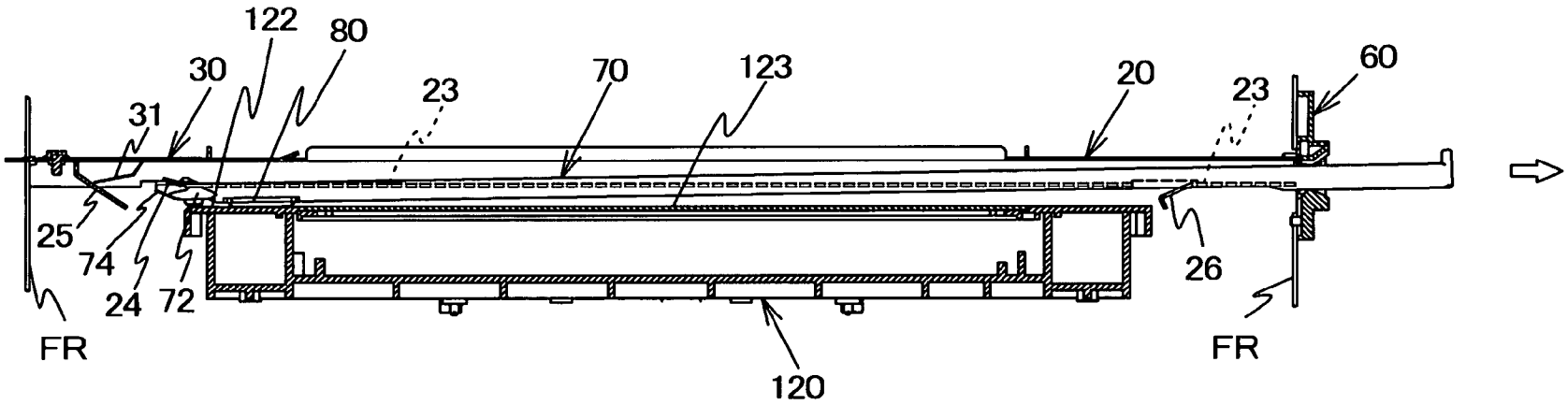
FIG. 19A and FIG. 19B are cross-sectional views showing the operation of the cleaning mechanism at the time of pulling the cleaning rod.

Firstly, referring now to FIG. 19A, when the cleaning rod 70 is pulled to the outside of the cleaning mechanism 10 from the state shown in FIG. 18B, the front end portion of the cleaning rod 70 recedes. The contact portion 74 of the cleaning rod 70 moves downward in a direction of approaching the cover 122 of optical scanning unit 120, while sliding downward the tilted surface of the receiving portion 25. Then, the pad 80 is brought into contact with the surface of the cover 122. The slide portion 72 of the cleaning rod 70 is inserted into a gap between the guide rails 23 and the cover 122 by being guided by the end portions 24 that are tilted of the guide rails 23. When (the upper surface) of the slide portion 72 is engaged (contact) with (the lower surfaces) of the guide rails 23, the elastic member 82 of the pad 80 is compressed to have a given thickness and the cleaning member 83 is pushed to the cover 122 by a constant suppress strength.

Figure 19B:
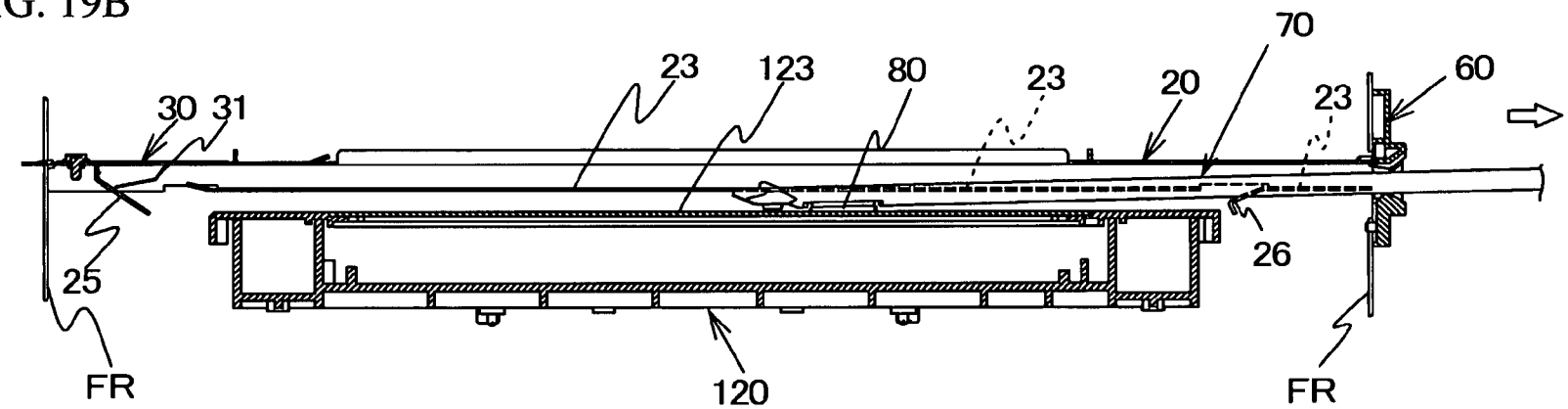

Referring now to FIG. 19B, when the cleaning rod 70 is further pulled to the outside of the cleaning mechanism 10 from the state shown in FIG. 19A, the pad 80 slides on the surface of the seal glass 123 from the state shown in FIG. 19A. This cleans the surface of the seal glass 123.

Figure 20A:
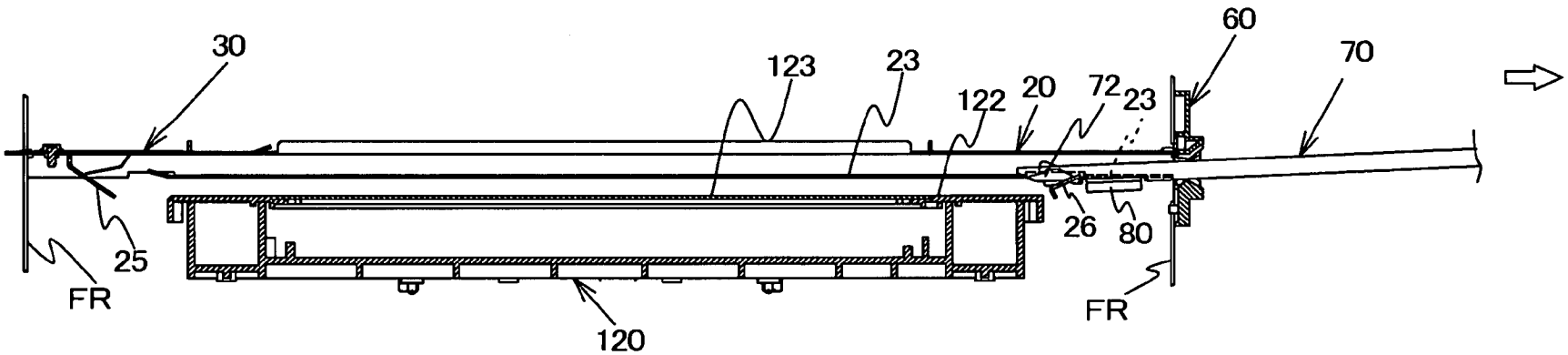
FIG. 20A and FIG. 20B are cross-sectional views showing the operation of the cleaning mechanism subsequent to FIG. 19B.

The pad 80 passes through the surface of the seal glass 123, moves onto the surface of the cover 122 again, and the cleaning process is completed. Referring now to FIG. 20A, the slide portion 72 of the cleaning rod 70 moves onto the guide portions 26, and is again guided onto the guide rails 23.

Figure 20B:
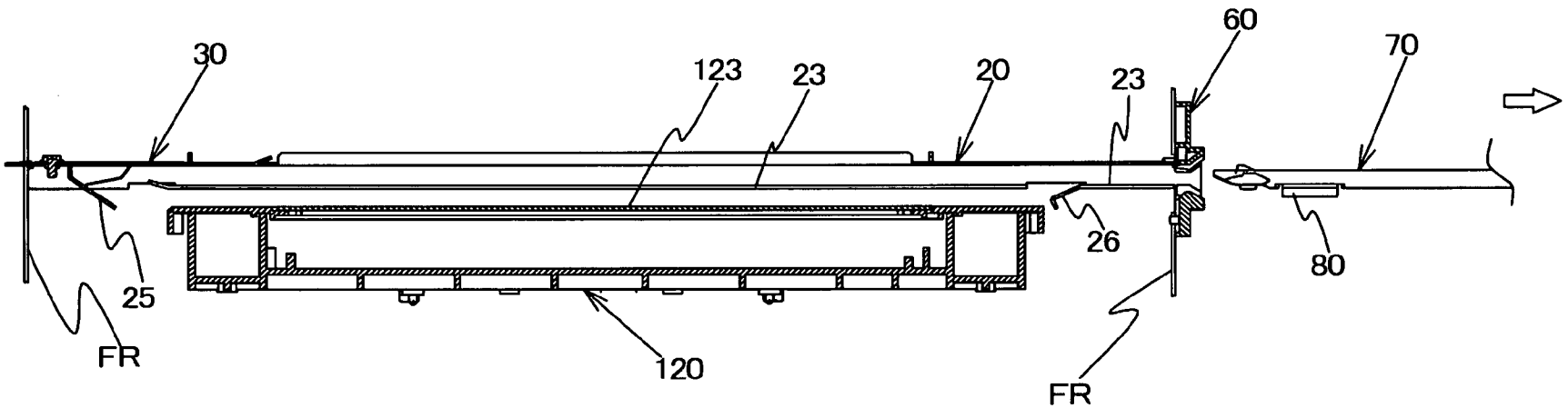

Referring now to FIG. 20B, as the cleaning rod 70 is further pulled to the outside of the cleaning mechanism 10, the cleaning rod 70 is completely drawn from the cleaning mechanism 10.

In the above-described embodiment, the description has been given of the case where the receiving portion 25 and the guide portions are integrally formed with the guide rail member 20. However, the present invention is not limited to this. The receiving portion 25 and the guide portions may be formed separately from the guide rail member 20.

In the above-described embodiment, the description has been given of the case where the seal glass 123 is cleaned at the time of pulling the cleaning rod. However, the present invention is not limited to this. The seal glass 123 may be cleaned at the time of inserting the cleaning rod 70, and then the front end portion of the cleaning rod may be held at the insertion completed position, so that the pad is spaced apart from the optical scanning unit 120 and above the optical scanning unit 120.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

CROSS-REFERENCE TO RELATED APPLICATIONS

This application is based on and claims priority under 35 USC 119 from Japanese Patent Application No. 2006-027798 filed on Feb. 3, 2006.

What is claimed is:

1. An image forming apparatus comprising:

an optical scanning unit having a light transmitting portion disposed across the optical scanning unit, and the light transmitting portion's surface is oriented along its longitudinal axis; and a cleaning mechanism that includes:

a cleaning rod with a pad at a front end portion thereof to be capable of cleaning the surface of the light transmitting portion by sliding on the light transmitting portion surface; and a retaining mechanism that retains the cleaning rod slidably in the longitudinal direction of the light transmitting portion surface, and that retains the pad positioned above the optical scanning unit and substantially spaced apart from the optical scanning unit in a state where the cleaning rod is at an insertion completed position.

2. An image forming apparatus comprising:

an optical scanning unit having a light transmitting portion disposed across the optical scanning unit, and the light transmitting portion's surface is oriented along its longitudinal axis; and a cleaning mechanism that includes:

a cleaning rod with a pad at a front end portion thereof to be capable of cleaning the surface of the light transmitting portion by sliding on the light transmitting portion surface; and a retaining mechanism that retains the cleaning rod slidably in the longitudinal direction of the light transmitting portion surface, and that retains the pad positioned above the optical scanning unit and substantially spaced apart from the optical scanning unit in a state where the cleaning rod is at an insertion completed position, the retaining mechanism that includes:

a guide rail that retains the front end portion of the cleaning rod so that the pad is substantially spaced apart from the surface of the optical scanning unit, when the cleaning rod is inserted, and that is engaged with the front end portion of the cleaning rod to bring the pad substantially into contact with the light transmitting portion surface of the optical scanning unit, when the cleaning rod is pulled; and a receiving portion that receives the front end portion of the cleaning rod separated from an end portion of the guide rail before the insertion completed portion at a position substantially spaced apart from the surface of the optical scanning unit, when the cleaning rod is inserted.

3. The image forming apparatus according to claim 2, wherein the receiving portion is substantially tilted to a direction of inserting the cleaning rod.

4. The image forming apparatus according to claim 2, wherein the retaining mechanism includes a biasing member that biases the front end portion of the cleaning rod to be engaged with the receiving portion, toward the optical scanning unit.

5. The image forming apparatus according to claim 4, wherein:

the retaining mechanism includes a guiding member having an inserting opening, the front end portion of the cleaning rod being inserted into the inserting opening;

the front end portion of the cleaning rod has a reverse insertion preventing projection to be fitted into a reverse insertion preventing groove defined at the inserting opening; and the biasing member is engaged with the reverse insertion preventing projection.

6. The image forming apparatus according to claim 2, wherein the retaining mechanism includes a guide portion that guides the front end portion of the cleaning rod moving between the optical scanning unit and the guide rail onto the guide rail so that the pad is substantially spaced apart from the optical scanning unit, when the cleaning rod is pulled and after the pad passes sliding on the surface of the light transmitting portion.

7. An image forming apparatus comprising:

an optical scanning means having a light transmitting portion disposed across the optical scanning means, and the light transmitting portion's surface is oriented along its longitudinal axis; and a cleaning mechanism that includes:

a cleaning rod means with a pad at a front end portion thereof to be capable of cleaning the surface of the light transmitting portion by sliding on the light transmitting portion surface; and a retaining means for retaining the cleaning rod slidably in the longitudinal direction of the light transmitting portion surface, and for retaining the pad positioned above the optical scanning means and substantially spaced apart from the optical scanning means in a state where the cleaning rod is at an insertion completed position.

* * * * *